US005671783A

United States Patent [19]

Zenoni et al.

[11] Patent Number: 5,671,783

[45] Date of Patent: Sep. 30, 1997

[54] WEFT FEEDER WITH TURN SEPARATOR INCLUDING MULTIPLE DIAMETER SWIFT

[75] Inventors: Pietro Zenoni; Giovanni Pedrini, both of Leffe; Rosario Castelli, Gandino, all of Italy

[73] Assignee: L.G.L. Electronics S.p.A., Bergamo, Italy

[21] Appl. No.: 535,257

[22] PCT Filed: Mar. 1, 1995

[86] PCT No.: PCT/EP95/00746

§ 371 Date: Oct. 30, 1995

§ 102(e) Date: Oct. 30, 1995

[87] PCT Pub. No.: WO95/24521

PCT Pub. Date: Sep. 14, 1995

[30] Foreign Application Priority Data

Mar. 7, 1994 [IT] Italy ..... T094A0154

[51] Int. Cl.[6] ..... D03D 47/36; B65H 51/22

[52] U.S. Cl. ..... 139/452

[58] Field of Search ..... 139/452

[56] References Cited

U.S. PATENT DOCUMENTS 5,046,537 9/1991 Maina ..... 139/452

5,201,347 4/1993 Maina ..... 139/452

FOREIGN PATENT DOCUMENTS 0363980 4/1990 European Pat. Off. .

0469527 2/1992 European Pat. Off. .

*Primary Examiner*—Andy Falik

*Attorney, Agent, or Firm*—Guido Modiano; Albert Josif; Daniel O'Byrne

[57] ABSTRACT

A weft feeder in which a variable-diameter drum receives from a windmilling arm multiple turns of thread that form a weft reserve, and in which a variable-diameter swift is associated with the drum to transport the turns from the base of the drum to its head; the swift is formed by multiple rods which protrude in a cyclic manner from corresponding slots of the drum; the extent of the protrusion of the rods from the slots determines the mutual distance between the turns of the thread reserve. The swift and the drum are formed by corresponding sectors that are radially movable and are controlled by respective radial shifting mechanisms, each of which comprises at least one actuation gear that meshes with individual gears for shifting the respective drum and swift sectors. The pair of actuation gears is turned by a single transmission element which is controlled by an actuation knob that is also used to vary the extent of the protrusion of the rods.

25 Claims, 7 Drawing Sheets

WEFT FEEDER WITH TURN SEPARATOR INCLUDING MULTIPLE DIAMETER SWIFT

BACKGROUND OF THE INVENTION

The present invention relates to a weft feeder with turn separator for air jet looms with high insertion speed.

It is known that weft feeders are devices adapted to accumulate a reserve of thread in the form of turns wound on a fixed drum and to feed the loom by unwinding the accumulated turns by an extent that is equal to the length L of thread required by said loom at each beating; said length is equal to the transverse dimension, or width H, of the fabric being formed.

In the specific case of air jet looms, the feeder also has the task of preliminarily measuring the length L of thread; this task is performed in a known manner both by counting, by means of an optical sensor, the number "n" of unwound turns of thread, and by varying the diameter D of the winding drum, wherein:

$$L=n\pi D$$

The unwinding of the thread is controlled by an electromagnetic braking unit which, by means of a moving probe, stops the advancement of the thread when the n-th turn has been reached; the diameter D of the feeder drum is adjusted so as to always be a submultiple of the width H of the fabric being produced.

In a per se known manner, the reserve of weft is wound on the feeder drum by a windmilling arm; a transport system gradually moves the turns from the base of the drum to its head, keeping them mutually separated; said transport system is typically formed by a swift composed of rods to which an undulatory motion is imparted by an angled bushing and which periodically protrude from corresponding slots of the drum. The distance between the turns, which is chosen according to the type of thread being processed in order to avoid tangles or overlapping of turns, depends on the extent to which the rods protrude with respect to the slots of the drum and can be changed significantly, for example by more than a millimeter, by varying said protrusion value slightly, for example by 2–3 tenths of a millimeter.

It is evident that when the diameter D of the drum varies, the diameter of the transporting rod-based swift must be correspondingly varied, so that said rods can continue to protrude to a preset extent from the slots of the drum which has a different diameter.

Various solutions have already been provided for this purpose which are based on the concept of dividing said drum and said rod-based swift into sectors—typically four sectors arranged at 90° to each other—and of controlling the sectors by means of an element that allows to vary their radial position, particularly to expand them from a minimum-diameter position to a maximum-diameter position and vice versa.

According to some known solutions, the diameter of the rod-based swift and of the drum are changed individually by means of corresponding elements for moving the respective sectors. However, adjustment systems of this type have several drawbacks, mainly a considerable structural complexity of the shifting elements and considerable difficulty in the adjustment operations, which require long execution times and the intervention of specialized operators. These systems are furthermore not suited for automation by means of actuators driven by control units.

According to other known solutions, the diameter of the transporting rod-based swift and of the drum are changed simultaneously by means of a single element which acts on the sectors of both parts to expand and contract them to the same extent.

Known systems of this kind, despite being more advantageous than the preceding ones, have the severe drawback that they do not allow to adjust the extent of the protrusion of the rods of the swift from the slots of the drum, and accordingly do not allow to vary the distance that separates the turns from the weft reserve, with consequent difficulty in adapting the feeder to the various types of thread being processed; the distance between the turns can be changed only by replacing the angled bushing which applies the undulatory motion to the transporting rod-based swift.

SUMMARY OF THE INVENTION

A principal aim of the present invention is essentially to obviate these and other drawbacks of known air jet loom feeders, and within the scope of this general aim said invention has the following important particular objects:

- to provide a feeder for air jet looms equipped with a mechanism that allows to vary the diameter of the turn winding drum and of the transporting rod-based swift and at the same time to vary the extent of the protrusion of the rods from the respective slots of the drum in order to vary the turn separation distance;
- to provide a feeder with a mechanism for varying the diameters of the drum and of the transporting rod-based swift and for varying the extent of the protrusion of the rods which allows very fine adjustments of said protrusion value, is reliable in operation, is easy to operate, and can be driven by automation actuators activated by a process controller.

In particular, according to a different embodiment of the invention, said mechanism is provided so as to allow a significant variation in at least one transverse dimension of the drum during the operation of the feeder so as to correct, under the control of said process controller, the diameter of the drum according to the increase in the tension of the thread that is produced as the diameter of the feeder spool decreases.

A further object of the invention is to provide a feeder with a variation mechanism for the above specified purposes which has an extremely limited overall size, particularly a size that does not require significant variations in the axial and radial dimensions of the feeder and does not require any modification of the thread path both at the inlet and at the outlet of the feeder.

According to the invention, this aim, these and other important objects, are achieved by providing a weft feeder for air jet looms with turn separator having the characteristics described in the appended claims.

Substantially, the invention is based on the concept of controlling the individual sectors of the turn-transporting rod-based swift and of the turn winding drum by means of respective radial shifting mechanisms, each of which comprises at least one actuation gear which is rotatably mounted coaxially to the drive shaft of the feeder and meshes, by means of a front set of teeth, with individual gears for shifting the respective drum and swift sectors. The two actuation gears, termed respectively as first gear and second gear, are both turned by a single transmission element which is controlled by an actuation knob and couples torsionally in succession with one actuation gear and with the other actuation gear after respective angular movements, defined as idle motions, which have different lengths.

The angular difference between said idle motions of the transmission element is used to adjust the extent of the protrusion of the turn-transporting rods. Typically, according to an embodiment of the invention, the transmission element is constituted by a cylinder that is freely rotatable and has, on either face, respective axial lugs which are shaped like a parallelepiped and are adapted to engage corresponding slots of the first and second gears respectively.

The slots of the two gears are wider than the lugs, particularly in a transverse direction, and said widths are different; typically, the slot of the second gear is wider than the slot of the first gear. Accordingly, the transmission element, after an idle angular stroke having a preset value $\alpha$, engages and turns the first gear, radially shifting the sectors of the transporting rod-based swift and subsequently, after an idle stroke having a total angular value $\beta$, engages and turns the second gear, causing the radial movement of the drum sectors.

The angular difference $\delta=\beta-\alpha$ is used to vary the extent of the protrusion of the transporting rods, as will become apparent hereinafter.

For this purpose, after adjusting the diameter of the drum and of the transporting rod swift, for example by rotating the actuation knob clockwise, said actuation knob can be rotated counterclockwise through a maximum useful angle $\delta$, obtaining corresponding reductions only in the diameter of the transporting rod swift and, accordingly, corresponding variations in the extent of the protrusion of said rods from the slots of the drum.

According to a different embodiment of the invention, oppositely arranged pairs of sectors of the swift and of the cylinder are moved by respective independent mechanisms, since corresponding pairs of first and second actuation gears associated with the corresponding pairs of sectors of the swift and of the drum are provided. Each gear of each pair meshes with the shifting gears of a pair of oppositely arranged sectors of the swift and respectively of the drum, and in this manner oppositely arranged pairs of sectors can be moved independently; this, as will become apparent hereinafter, allows to correct the diameter of the drum during the operation of the feeder.

BRIEF DESCRIPTION OF THE DRAWINGS

Further characteristics and advantages of the feeder according to the present invention will become apparent from the accompanying drawings, given only by way of non-limitative example, wherein.

DESCRIPTION OF THE PREFERRED EMBODIMENTS

Figure 1:
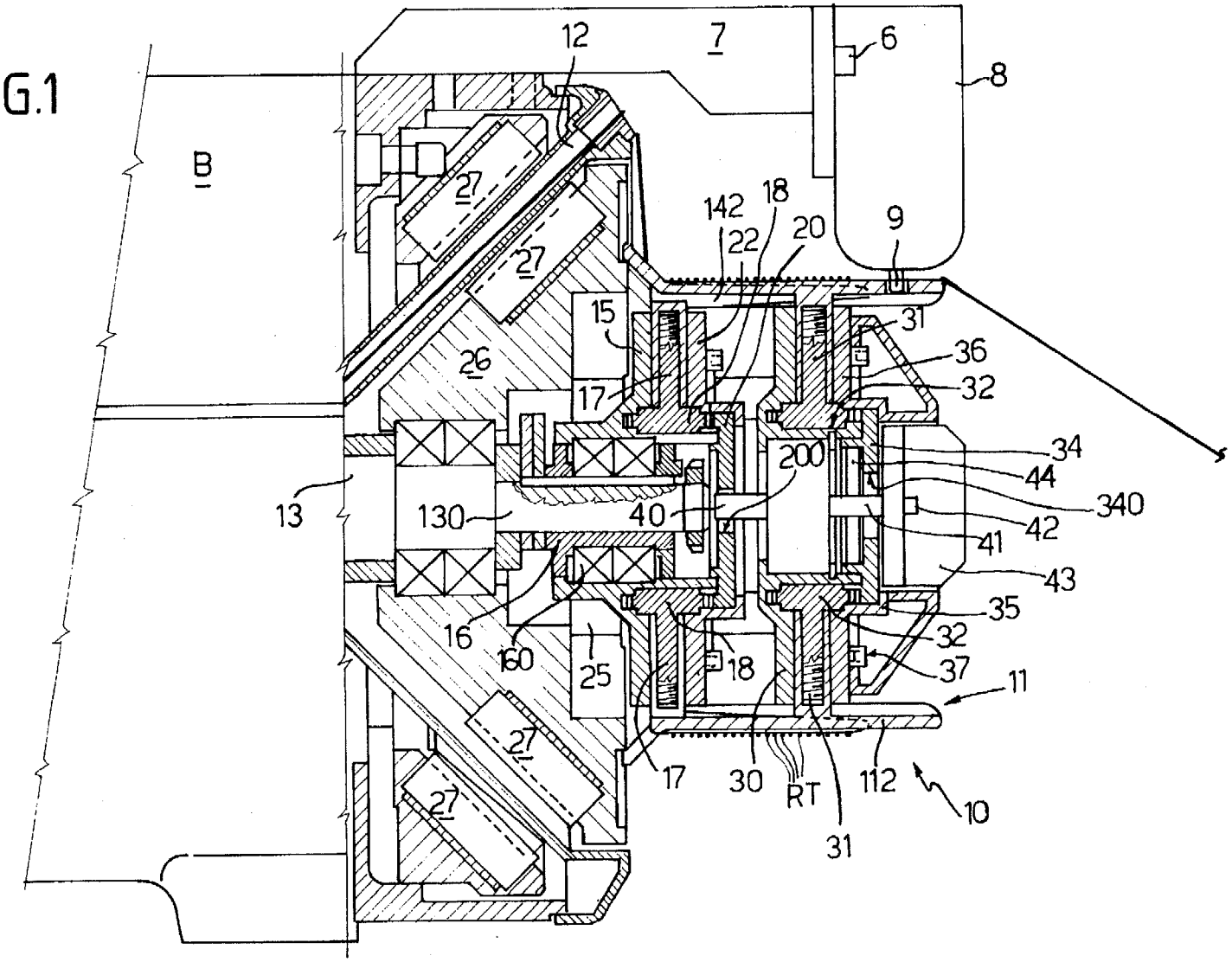
FIG. 1 is a partial axial sectional view of the feeder for air jet looms with turn separator according to one embodiment of the invention.

Initially with reference to FIGS. 1 to 5, the reference numeral 10 generally designates the front part of a weft feeder for air jet looms, which comprises a rotating drum 11 on which a windmilling hollow arm 12, driven by a drive shaft 13, feeds multiple turns of thread that constitute a weft reserve RT. When requested by the loom (not shown), the turns unwind from the drum 11 and a braking rod 9, actuated by an electromagnetic actuator 8, stops the unwinding of the thread when the above specified length L is reached; the actuator 8 is supported, so that it can be adjusted in a radial direction, by a support 7 by means of bolts 6. In a per se known manner, the drum 11 has multiple axial slots 110 (FIG. 4) from which corresponding transport rods 140 protrude in a cyclic manner; said rods are suitable to cause the advancement of the turns from the base of the drum 11 to its head to restore the reserve RT.

Figure 2:
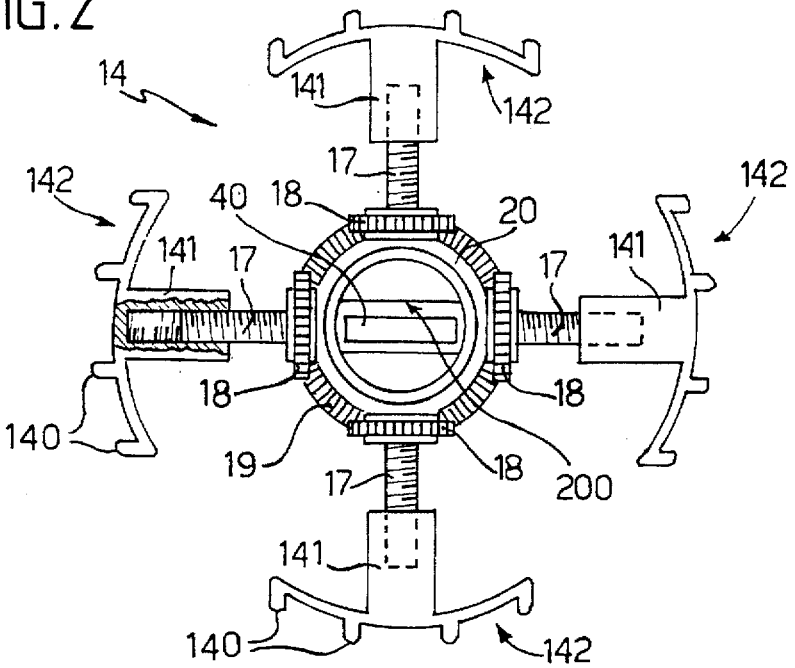
FIGS. 2 and 3 are schematic front views of the mechanisms for the radial shift of the sectors of the swift and respectively of the drum.

The rods 140 are supported by a respective first disk-like support 15, in combination with which they substantially form a variable-diameter swift 14, and have a composite undulatory motion which is applied in a per se known manner to the disk-like support 15 by an angled bushing 16 which is mounted on an eccentric portion 130 of the drive shaft 13 and supports the disk-like support 15 so that it can rotate freely, with the interposition of bearings 160. Said disk-like support is provided with radial slots 150; a corresponding spoke 141 slidingly engages in each one of said slots 150 and supports a set of transporting rods 140, for example a set comprising four rods, which form a rod sector 142 that is radially movable with respect to the support 15. Four sectors such as 142 are arranged at 90° to each other to form the variable-diameter transporting-rod swift 14, and there is a mechanism for expanding or contracting the sectors 142 (FIG. 2).

For this purpose, each one of the spokes 141 that support the sectors 142 is provided with a threaded axial hole in which a corresponding threaded radial pivot 17 engages; said pivot is provided with a respective sector shifting gear 18. Seats 151 are formed at the base of each slot 150 to partially accommodate the respective shifting gears 18.

As clearly shown in the figures, the shifting gears 18 mesh with the front set of teeth 19 of a first actuation gear 20 which is arranged coaxially to the drive shaft 13 and is accommodated, so that it can rotate freely, in the bell-shaped seat 21 of a disk-like flange 22 that is arranged adjacent to the disk-like support 15 and rigidly coupled thereto it by means of bolts 23.

Figure 5:
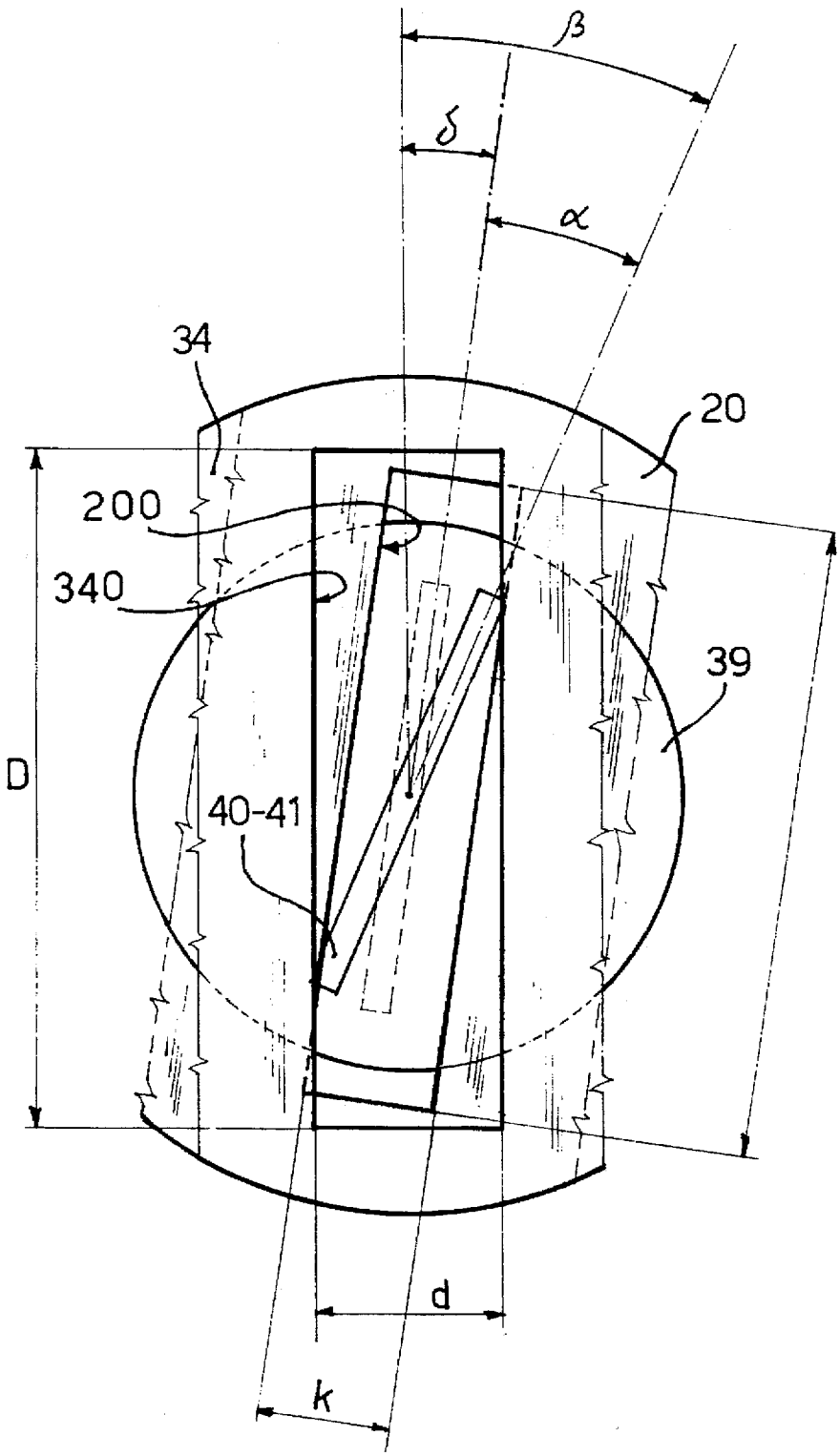
FIG. 5 is a diagram of the angular adjustment movements related to the mechanism of FIG. 4.
Figure 6:
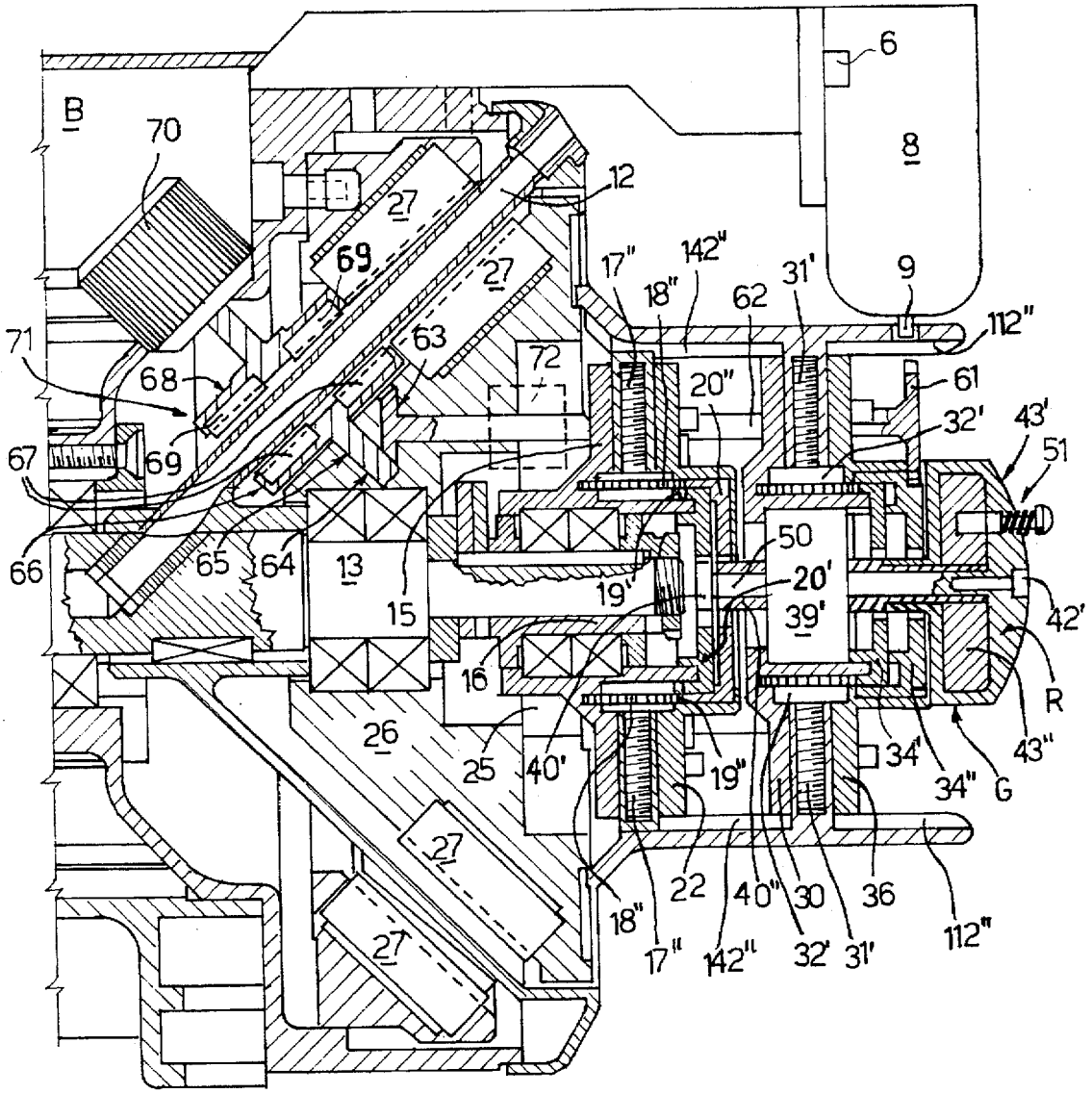
FIG. 6 is an axial sectional view, similar to FIG. 1, of a different embodiment of the invention.

The first actuation gear 20 is provided with a central rectangular slot 200 which has a preset size and is characterized by a shorter side "d" and by a longer side "D" (FIG. 5). Four through holes 24 arranged at 90° to each other are formed in the disk-like support 15 and in the disk-like flange 22. The holes 24 are crossed by corresponding axial posts 25 which are screwed to a fixed support 26 of the feeder 10, to which the drum 11 is rigidly coupled; the support 26 is rigidly coupled to the fixed base B of the feeder in a per se known manner by means of pairs of oppositely arranged permanent magnets 27.

Figure 3:
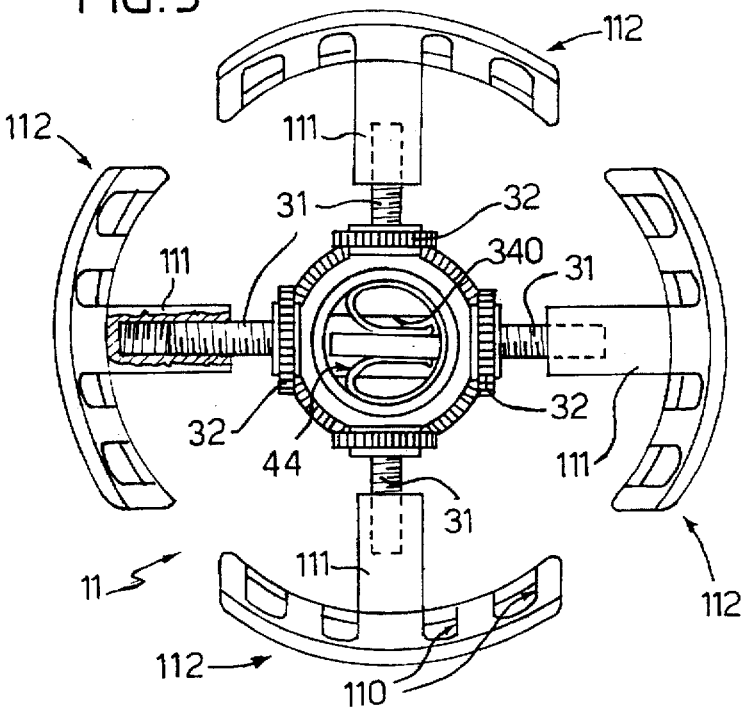
Figure 4:
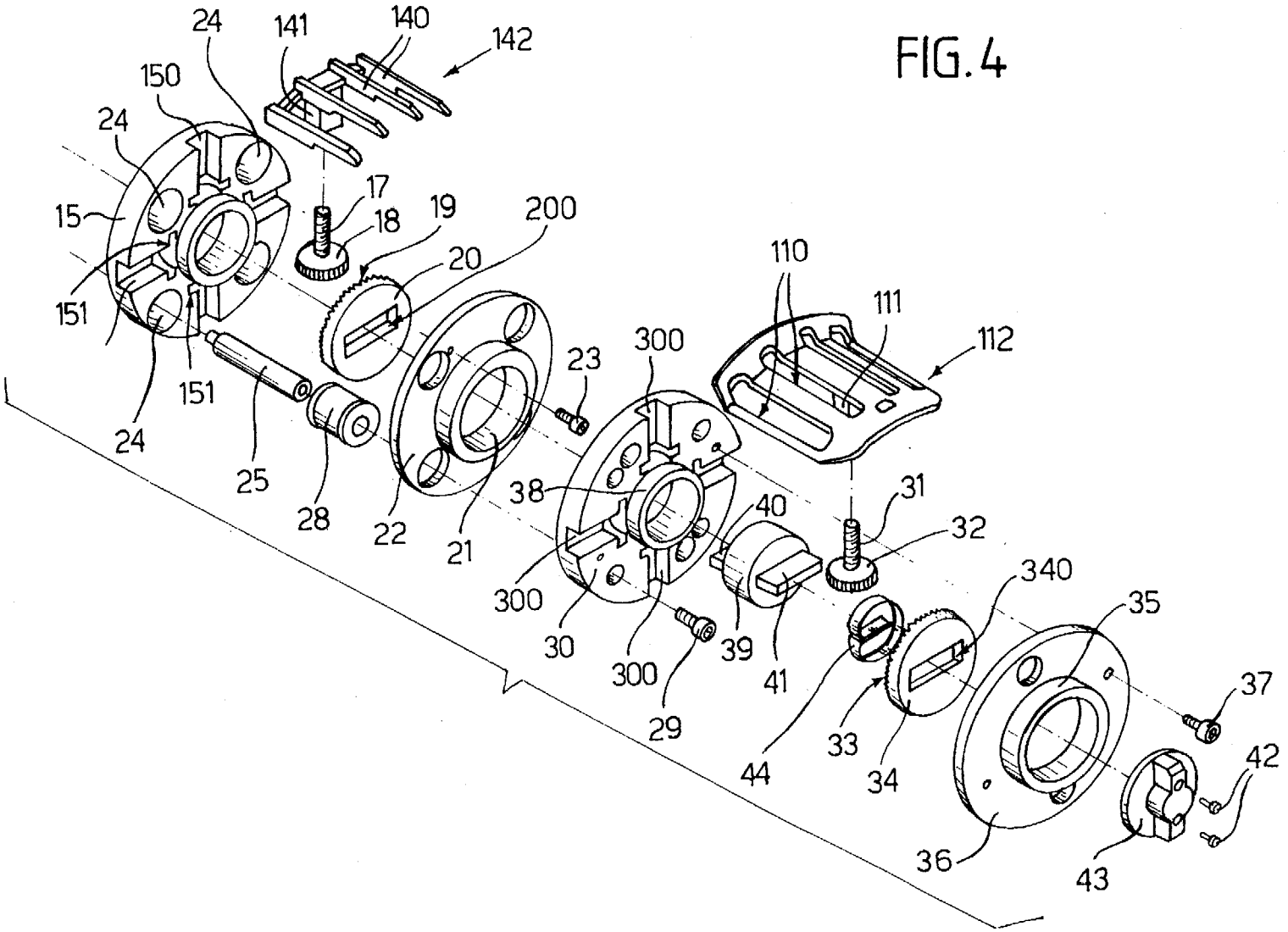
FIG. 4 is a partial exploded perspective view of the mechanism for varying the diameters and the extent of the protrusion of the rods which is associated with the feeder of FIG. 1.

Respective elastomeric sleeves 28 are fitted on the posts 25 at the region where the holes 24 are crossed, and allow the undulatory motion of the disk-like support 15, of the disk-like flange 22 that is rigidly coupled thereto, and of the actuation gear 20. A second fixed disk-like support 30 is rigidly coupled to the free ends of the posts 25 by means of bolts 29 and is arranged coaxially to the drive shaft 13. The disk-like support 30 also has respective radial slots 300 that accommodate, so that they can slide freely, respective spokes 111 for supporting corresponding sectors 112 of the fixed drum 11; there are four sectors such as 110 which are arranged at 90° to each other so as to form the variable-diameter drum 11, and there is a mechanism for expanding or contracting the sectors 110 (FIG. 3).

For this purpose, in a manner that is fully similar to the one described above, the spokes 111 have respective threaded holes with which corresponding threaded radial pivots 31 cooperate; said pivots are provided, at their end, with gears 32 for shifting the respective sectors 112. The gears 32 mesh with the front set of teeth 33 of a second actuation gear 34 which has a rectangular central slot 340 characterized by a shorter side "k" and by a longer side "H" (FIG. 5). The gear 34 is contained, so that it can rotate freely, in the cylindrical axial seat 35 of a flange 36 which is rigidly coupled to the fixed disk-like support 30 by means of bolts 37. A cylindrical seat 38 is formed in the central part of the fixed support 30 and accommodates, so that it can rotate freely, a single transmission element for said first and second actuation gears 20–34. Said transmission element is constituted by a cylinder 39 having, on its opposite faces, respective lugs 40–41 which are shaped like parallelepipeds, protrude axially along a same diameter of the cylinder 39, and are suitable to engage the corresponding slots 200 and 340 of the first and of the second actuation gears respectively. The lug 41 passes through the slot 340 of the gear 34 to connect, by means of screws 42, to an actuation knob 43 which is arranged frontally and centrally with respect to the drum 11. A cardioid-shaped spring 44 is interposed between the lug 41 and the slot 340 of the second gear and, as clearly shown in the detail view of FIG. 3, has the purpose of keeping the lugs 40 and 41 elastically centered with respect to the slots 200 and 340.

The two lugs 40–41 have the same rectangular cross-section, which is significantly smaller than both slots 200 and 340 of the first and of the second actuation gears respectively. In turn, the slots 200 and 340 have mutually different sizes, since the dimension "d" of the slot 200 is smaller than the corresponding dimension "k" of the slot 340, typically d=0.6–0.7 k, and since the dimension "D" of the slot 200 is larger than, or equal to, the dimension "H" of the slot 340, typically H=0.8–1.D, in order to allow the undulatory motion of the gear 20 rigidly with the support 15 without interference with the lug 40 (FIG. 5).

With this arrangement, the knob 43 must perform a movement, which is defined as idle motion and has a preset angular value $\alpha$, before the lug 40 engages the lateral surface of the slot 200 and before the actuation gear 20 starts to be moved, and a second movement, which is also defined as idle motion and has an angular value $\beta$, before the lug 41 engages the lateral surface of the slot 340 and before the actuation gear 34 starts to be moved. Since $\beta>\alpha$, when the angular motion $\beta$ of the knob 43 is completed, the lug 40 has already produced an angular motion $\delta=\beta-\alpha$ of the gear 20 which is useful for the radial expansion of the sectors 142 of the transporting rods.

The consequent increase $\theta$ in the diameter of the transporting rod swift 14 with respect to the diameter of the drum 11, which is still unchanged, corresponds to the maximum protrusion value of the rods 140 with respect to the slots 110 of said drum. As the rotation of the knob 43 continues beyond the angle $\beta$, the lug 41 also moves the gear 34, so that the two gears 20 and 34 move simultaneously to increase the diameters of the swift 14 and of the drum 11, although the diameter of the swift remains greater than the diameter of the drum by said incremental value $\theta$.

Once the diameter has been adjusted, the knob 43 can be rotated in the opposite direction through a maximum angle, equal to $\delta$, which is useful for reducing the incremental value $\theta$ and therefore the extent of the protrusion of the rods 140 of the swift 14 with respect to the slots 110 of the drum 11. Since by releasing the knob 43 the spring 44 returns the lugs 40–41 into a central position with respect to the slots 200–340, the useful angular motion for varying said protrusion value of the rods is achieved after the idle angular motion $\alpha$ of said knob in said corresponding opposite rotational direction.

It is evident that the variation in the diameter of the swift and of the drum must be associated with a corresponding radial motion of the electromagnetic actuator 8; this is done manually, after loosening the bolts 6 that rigidly couple said actuator to the corresponding support 7 while the feeder is not moving.

However, the different embodiment of FIGS. 6 to 9, in which similar or corresponding parts are designated by the same reference numeral, allows significant corrections of the diameter selected for the drum and consequent corrections of the amount L of thread fed to the loom in a fully automatic manner, without requiring any manual intervention to move the actuator 8.

Correction of the diameter selected for the drum during the operation of the feeder is required by the increase in the tension of the thread caused by the decrease in the diameter of the spool as said spool empties. An increase in the tension of the thread in fact is usually followed by a reduction in the amount L of thread fed at each beating. This reduction is currently detected by appropriate sensors that stop the loom to avoid short wefts. According to the above embodiment, the signal related to the reduction in the length L is instead used to automatically correct the diameter of the drum 11 and accordingly restore the correct value of the amount L during the operation of the feeder.

Figure 7:
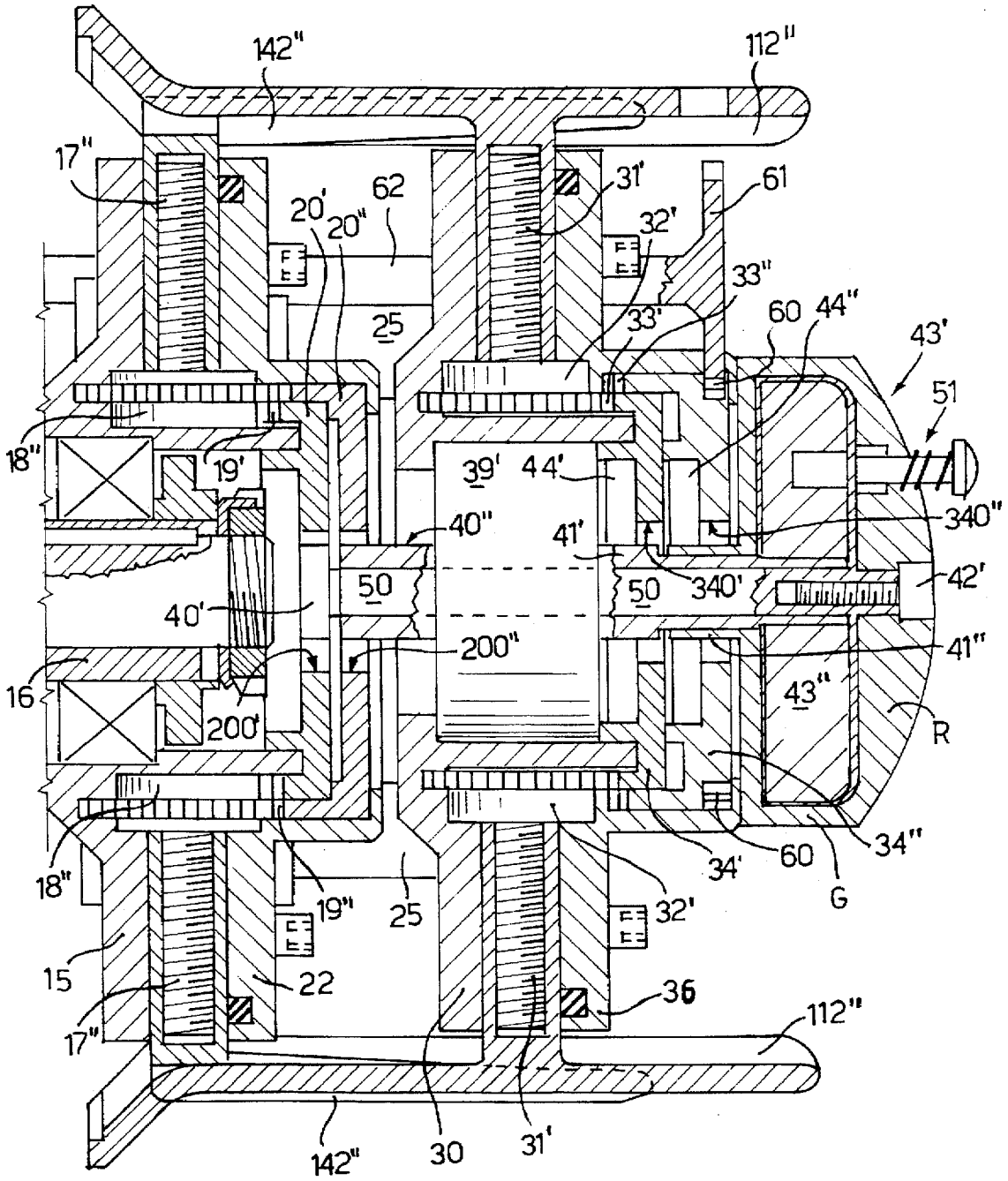
FIG. 7 is an enlarged-scale view of a detail of FIG. 6.
Figure 8:
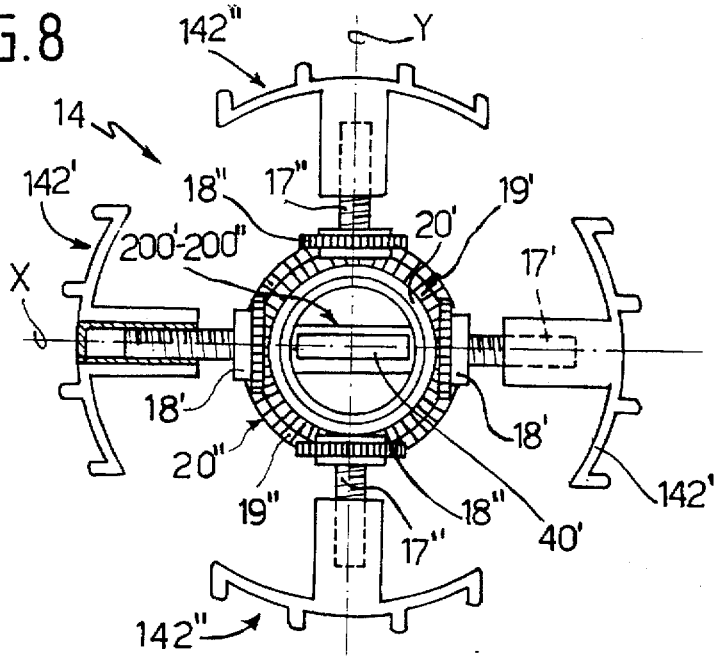
FIGS. 8 and 9 are schematic front views of the mechanisms for the independent shifting of the pairs of oppositely arranged sectors of the swift and of the drum according to the different embodiment of FIG. 6.
Figure 9:
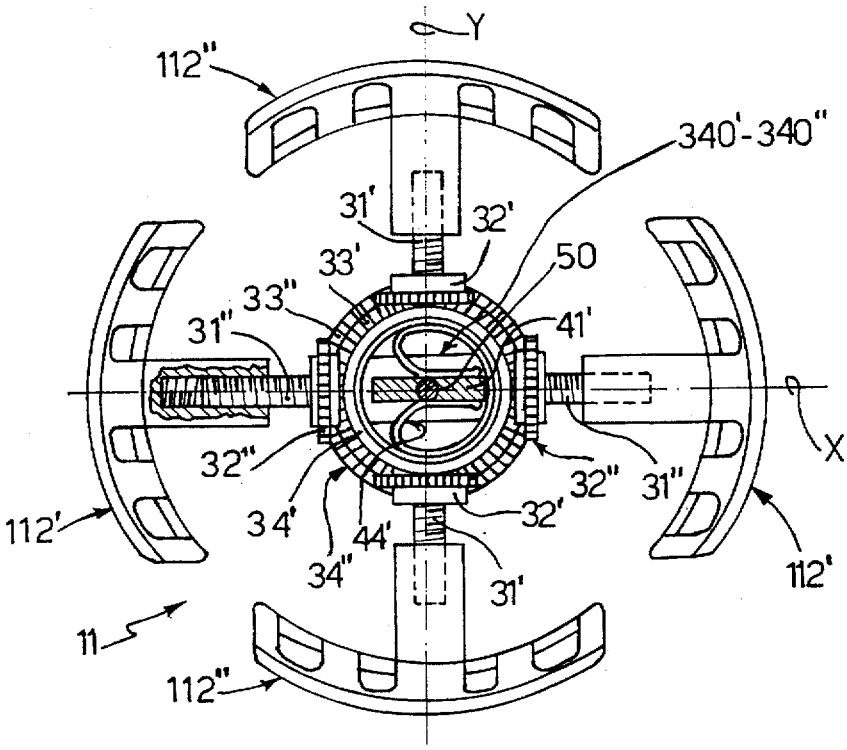

According to the above different embodiment, this is achieved by virtue of the fact that the sectors of the swift 14 and of the drum 11 are shifted independently in opposite pairs by respective independent mechanisms. In FIGS. 7 and 8 there is one mechanism for shifting the first pair of opposite swift sectors 142' arranged along the diameter "x" of the swift 14, termed as transverse diameter, and there is another mechanism for shifting, independently of the first pair, the second pair 142" of opposite swift sectors arranged along the diameter "y" of said swift, which lies at right angles to the first one.

Likewise, there is one mechanism for shifting the first pair of opposite drum sectors 112' arranged along the diameter "x" of the drum 11 and there is another mechanism for shifting, independently of the first one, the second pair of drum sectors 112" arranged along the axis "y" of said drum.

In order to automatically correct the diameter of the drum 11 during the operation of the feeder, only the pairs of sectors 112' and 142' are shifted, as will be described hereinafter, and this does not require any movement of the actuator 8. Each one of the mechanisms for shifting the oppositely arranged pairs of sectors of the swift 14 includes corresponding first actuation gears 20' and 20" which are provided with respective front sets of teeth 19' and 19" and with respective aligned diametrical slots 200' and 200" and are arranged coaxially one inside the other; the gear 20" which has the largest diameter is bell-shaped so as to contain the gear 20' so that it can rotate coaxially and freely.

A respective pair of shifting gears 18' meshes with the set of teeth 19' of the gear 20'; said shifting gears are supported by corresponding threaded pivots 17' that engage the threaded spokes of the pair of opposite sectors 142' arranged along the diameter "x". Likewise, a pair of shifting gears 18" meshes with the set of teeth 19" of the gear 20"; said shifting gears are supported by pivots 17" that cooperate with the spokes of the second pair of opposite swift sectors 142" arranged along the diameter "y".

A transmission lug 40' engages the slot 200' of the gear 20' and is provided at the end of an actuation shaft 50 which is accommodated in the cylindrical hole of a transmission element 39'; the end of said shaft that lies opposite to the lug 40' is rigidly coupled, by means of a bolt 42', to a first external knob portion 43' which is formed by a ring G and by a diametrical spoke R.

The element 39' is in turn provided with a lug 40" that engages the slot 200" of the gear 20". The mechanism for actuating the oppositely arranged sectors of the drum 11 is provided in a fully similar manner; for this purpose there is a corresponding pair of second actuation gears 34' and 34" which are arranged coaxially, the first one inside the second one; said gears are provided with respective front sets of teeth 33'–33" and with respective aligned diametrical slots 340'–340". The front set of teeth 33' of the gear 34' meshes with a pair of shifting gears 32' that are rigidly coupled to respective threaded shafts 31' that cooperate with the threaded holes of the spokes of the second pair of sectors 112" of the drum 11 which are movable along the diameter "y". In turn, the front set of teeth 33" of the gear 34" meshes with a pair of gears 32" which are rigidly coupled to respective threaded pivots 31" that cooperate with the threaded holes of the spokes of the first pair of sectors 112' that are movable along the transverse diameter "x". A second lug 41' having a rectangular cross-section is provided on the element 39' and is adapted to engage, with the interposition of a cardioid-shaped spring 44', the slot 340' of the gear 34' to drive said gear. The slot 340" of the second gear 34" is instead engaged, with the interposition of a respective cardioid-shaped spring 44", by the rectangular stem 41" of the first knob portion 43', which is fitted, so that it can rotate freely, on a cylindrical end portion of the lug 41' which extends axially beyond the gears 34' and 34" to rigidly couple to a second knob portion 43" which is contained, so that it can rotate freely, in the first portion 43'; the shaft 50 is freely rotatable with respect to the second knob portion 43". A pawl 51 allows to rigidly couple the first and second knob portions or to make them rotate independently.

It is evident that with the described arrangement, by leaving the pawl 51 disengaged it is possible, by rotating the knob portion 43', to cause the corresponding rotation of the gears 20' and 34" alone and the consequent expansion (or contraction) of the sectors 142' and 112' along the diameter "x", whereas the rotation of the knob portion 43", by causing the rotation of the gears 20" and 34' alone, causes the consequent expansion (or contraction) of the sectors 142" and 112" alone along the diameter "y".

By connecting the two knob portions 43'–43" by means of the pawl 51, the expansion of the pairs of sectors of the swift 14 and of the drum 11 occurs simultaneously, as described with reference to the embodiment of FIGS. 1 to 5.

In order to automatically correct the diameter of the drum 11 during the operation of the feeder, since said correction is on the order of a few millimeters, the feeder uses the expansion of the pairs of sectors 112'–142' alone along the transverse axis "x" of said drum, after disengaging the pawl 51. For this purpose, the main gear 34" is provided with a second peripheral set of teeth 60 with which the corresponding set of teeth of a gear 61 arranged to the side of the knob 43 meshes. The gear 61 is keyed to the end of a shaft 62 that extends axially along the drum 11 and ends with a bevel gear 63 which is accommodated in a corresponding seat formed in the support 26. The gear 63 meshes with the corresponding bevel gear 64 of a transmission shaft 65 which ends with a first disk 66 arranged outside the support 26 and provided with one or more permanent magnets 67. A second disk 68 is arranged so as to face the disk 66 and is spaced therefrom by an extent that allows the free passage of the windmilling arm 12; said second disk 68 is correspondingly provided with one or more permanent magnets 69, and the magnets 67 and 69, which have opposite polarities, thus form a torsional coupling 71 without contact between the disks 66 and 68.

The disk 68 is keyed to the end of the shaft of an actuation motor 70 which is supported by the base B of the feeder and is controlled by a process controller (not shown).

The activation commands applied to the motor 70 cause respective rotations of the gears 61 and 34" and the corresponding correction of the diameter of the drum in the specified direction. The device that comprises the motor 70, the disks 66–68 with the respective magnets 67–69, and the shaft 62 can be used advantageously to move the gear 61 as described and/or a generator 72 arranged inside the drum 11 and suitable to supply power for electric and/or electronic components accommodated in said drum, without having to use systems for directly transmitting power without contact.

The details of execution and the embodiments may of course be changed extensively with respect to what has been described and illustrated by way of non-limitative example without altering the concept of the invention and without abandoning the scope thereof, which is defined by the appended claims, wherein the reference numerals are given only for the sake of clarity.

What is claimed is:

1. A weft feeder with turn separator, for air jet looms, the weft feeder comprising: a variable-diameter drum for supporting multiple turns of thread deposited on the drum by a windmilling arm, said turns forming a weft reserve; and a variable-diameter swift which includes multiple rods having an undulatory motion and protruding, in a cyclic manner, from corresponding slots of the drum to transport the turns of thread from the base of the drum to its head, and wherein the extent of the protrusion of the rods from the slots of the drum determines the mutual distance between the turns of the thread reserve; wherein said swift and said drum are formed by corresponding sectors that are independently radially movable and controlled by respective radial shifting mechanisms, each of which comprises at least one actuation gear that meshes with individual shifting gears for shifting the respective drum and swift sectors; wherein the actuation gears of said radial shifting mechanism are turned by a single transmission element which is controlled by an actuation knob and which couples in sequence to both actuation gears, through respective slots defined in said actuation gears, after said knob moves through respective idle angular motions having different values; the difference between said idle angular motions of the transmission element being used to vary the extent of the protrusion of the turn transporting rods, with respect to said sectors of the drum, to correspondingly adjust the distance between said turns.

2. A feeder according to claim 1, wherein said radial shifting mechanism comprises first and second actuation gears that mesh respectively with first and second sets of shifting gears, each set being formed by four gears; wherein the shifting gears of the first set are rigidly coupled to respective threaded pivots that engage the threaded holes of spokes of first corresponding sectors of the swift which are arranged at 90° to each other; and wherein the shifting gears of the second set are rigidly coupled to respective threaded pivots that engage in the threaded holes of the spokes of second corresponding sectors of the drum which are also arranged at 90° to each other.

3. A feeder according to claim 2, wherein the spokes of the sectors of the swift are slidingly guided in the radial slots of a first disk-like support which is mounted, so that it can rotate freely, on an angled bushing which is fitted on an eccentric portion of a drive shaft of the feeder, which applies an undulatory motion to said disk-like support and to the sectors of the swift.

4. A feeder according to claim 3, wherein the spokes of the sectors of the drum are slidingly guided in the radial slots of a second fixed disk-like support which is rigidly coupled to the ends of fixed axial posts which pass through corresponding holes of the first disk-like support with the interposition of elastomeric sleeves which are fitted on said hosts and allow the undulatory motion of the first disk-like support.

5. A feeder according to claim 4, wherein corresponding front disk-like flanges are associated with said first and second disk-like supports and are provided with respective bell-shaped seats for containing the first and the second actuation gears respectively.

6. A feeder according to claim 2, wherein said first and second actuation gears are provided with respective diametrical slots in which corresponding protruding lugs of the transmission element engage.

7. A feeder according to claim 6, wherein the transmission element is constituted by a cylinder which has said protruding lugs on its opposite faces.

8. A feeder according to claim 7, wherein the protruding lugs of the transmission element have identical rectangular cross-sections and lie along a same diameter of the cylinder that constitutes the transmission element.

9. A feeder according to claim 6, wherein the diametrical slots of the first and second actuation gears have a rectangular profile and different dimensions; and wherein at least the following relation holds:

$$d<k$$

where "d" is the shorter side of the slot of the first actuation gear and "k" is the shorter side of the slot of the second actuation gear.

10. A feeder according to claim 6, wherein at least the protruding lug of the transmission element that cooperates with the slot of the second actuation gear is controlled by the action of an elastic means having the purpose of keeping said lug elastically centered with respect to said slot.

11. A feeder according to claim 6, wherein the slot of the first actuation gear and the slot of the second actuation gear are engaged by the corresponding protruding lugs of the transmission element respectively as a consequence of said different idle angular motions of said transmission element, said motions being mutually different; wherein $$\alpha<\beta$$

where $\alpha$ is a first idle angular motion and $\beta$ is a second idle angular motion of the transmission element; and wherein the second angular motion of the actuation element causes, by moving the first actuation gear, an incremental variation in the diameter of the swift and accordingly in the extent of the protrusion of the transport rods; said incremental variation being adjustable by means of an opposite angular motion of the transmission element which has a useful maximum adjustment value that is equal to the difference between said second and said first angular motions of the transmission element; wherein $$\delta=\beta-\alpha$$

is said useful adjustment value.

12. A feeder according to claim 1, wherein the transmission element is actuated by said actuation knob which is torsionally coupled to said transmission element and is arranged centrally and frontally with respect to the drum.

13. A feeder according to claim 1, wherein it comprises independent mechanisms, each of which includes said actuation gears for shifting, independently and along mutually perpendicular diameters (x, y), opposite pairs of sectors of the swift and, respectively, oppositely arranged pairs of sectors of the drum.

14. A feeder according to claim 13, wherein it comprises a pair of first actuation gears which are arranged coaxially and are freely rotatable one inside the other; wherein each actuation gear meshes with a corresponding pair of shifting gears; wherein the gears of each pair are supported by respective threaded pivots which in turn engage the threaded holes of the spokes of a pair of oppositely arranged sectors of the swift; and wherein the pairs of threaded pivots are arranged along respective mutually perpendicular diameters (x, y).

15. A feeder according to claim 13, wherein it comprises a pair of second actuation gears which are arranged coaxially and freely rotatable one inside the other; wherein each actuation gear meshes with a corresponding pair of shifting gears; wherein the gears of each pair are supported by respective threaded pivots which in turn engage the threaded holes of the spokes of pairs of oppositely arranged sectors of the drum; and wherein the pairs of threaded pivots are arranged along respective mutually perpendicular diameters (x, y).

16. A feeder according to claim 15, wherein the pair of threaded pivots actuated by the inner gear of a pair of first actuation gears and supporting a respective pair of shifting gears is parallel to the pair of threaded pivots which are actuated by the outer gear of the pair of second actuation gears; and in that both of said pairs of threaded pivots are parallel to the transverse diameter (x) which is one of said mutually perpendicular diameters (x, y).

17. A feeder according to claim 15, wherein said device comprises a driving gear that meshes with a peripheral set of teeth of the outer gear of the pair of second actuation gears.

18. A feeder according to claim 17, wherein said driving gear is keyed to the end of a corresponding drive shaft which lies axially inside the drum and is driven by a motor, which is located on a fixed base of the feeder, by means of a transmission system and a contact-free torsional magnetic coupling which allows the windmilling arm to rotate freely.

19. A feeder according to claim 18, wherein the magnetic coupling comprises a first disk and a second disk which face each other but are separate, and in that the disks have respective permanent magnets having opposite polarities.

20. A feeder according to claim 18, wherein said drive shaft is used to turn said driving gear and/or a generator which is located inside the drum.

21. A feeder according to claim 14, wherein the pair of first actuation gears and a pair of second actuation gears are provided with respective diametrical aligned slots.

22. A feeder according to claim 21, characterized in that the slot of the inner gear of the pair of first actuation gears and the slot of the outer gear of the pair of second actuation gears are engaged, in order to move said gears, by a transmission lug which is supported at the end of an actuation shaft, whose other end is rigidly coupled to a first outer knob portion, and respectively by the rectangular stem of said outer knob portion.

23. A feeder according to claim 22, wherein the slot of the outer gear of the pair of first actuation gears and the slot of the inner gear of the pair of second actuation gears are engaged by respective oppositely arranged lugs of said transmission element which is rigidly connected to a second knob portion which is contained, so that it can rotate freely, in the first outer knob portion; a pawl being provided which allows to rigidly mutually couple the first and second knob portions or make them rotate freely with respect to one another, in order to produce the selective or simultaneous adjustment of the pairs of sectors of the swift and of the drum along the respective perpendicular diameters (x, y).

24. A feeder according to claim 23, wherein said transmission element and said second knob portion are provided with axial holes, said actuation shaft passing through said axial holes so as to rotate freely.

25. A feeder according to claim 13, wherein it comprises a device for selectively moving only the sectors of the drum and of the swift that are movable along a transverse diameter (x) of the drum in order to automatically correct the diameter of the drum during the operation of the feeder.

* * * * *